US006726459B1

(12) United States Patent
Gottemoller et al.

(10) Patent No.: US 6,726,459 B1
(45) Date of Patent: Apr. 27, 2004

(54) VARIABLE INJECTION RATE HIGH PRESSURE FUEL PUMP

(75) Inventors: Paul Gottemoller, Palos Park, IL (US); Ramesh B. Poola, Naperville, IL (US); Richard Wayne Tupek, Naperville, IL (US); Michael Barry Goetzke, Orland Park, IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/289,892

(22) Filed: Nov. 7, 2002

(51) Int. Cl.[7] ..... F04B 19/00; F04B 49/00; F01B 7/20; F01B 31/00

(52) U.S. Cl. ..... 417/470; 417/212; 417/274; 417/53; 92/52; 92/127; 123/446

(58) Field of Search ..... 92/52, 127, 172; 417/212, 213, 470, 274, 275, 53; 123/446, 447

(56) References Cited

U.S. PATENT DOCUMENTS 3,302,535 A * 2/1967 Procter et al. ..... 92/52
4,463,901 A * 8/1984 Perr et al. ..... 239/95
4,531,672 A * 7/1985 Smith ..... 239/89
4,560,326 A * 12/1985 Seki ..... 417/480
6,499,974 B2 * 12/2002 Bach ..... 417/549

OTHER PUBLICATIONS

"Electronically Controlled Injection Rate Shaping for Medium Speed Diesel Engines", International Council on Combustion Engines, Hamburg, Germany, pp. 511–517, dated 2001.

* cited by examiner

*Primary Examiner*—Justine R. Yu
*Assistant Examiner*—Timothy P. Solak
(74) *Attorney, Agent, or Firm*—Cary W. Brooks

(57) ABSTRACT

A high pressure fuel pump having a variable fuel injection rate, including a pump body, a pump cylinder formed in the pump body and a piston reciprocable within the pump cylinder, which defines a pressurization chamber. The pump piston has a reduced diameter portion which provides a primary piston. A piston annulus is slidably mounted thereon and provides a secondary piston. An annular actuation chamber adjoins the secondary piston opposite the pressurization chamber. An actuation passage is provided between a return fuel drain and the actuation chamber, which is selectively open or closed passively by pump piston movement and/or dynamically by operation of an actuation solenoid valve. If the actuation chamber passage is open, then during the pressurization stroke the secondary piston will remain stationary relative to the pump body, but if it is closed then the secondary piston must stroke in unison with the primary piston.

18 Claims, 3 Drawing Sheets

VARIABLE INJECTION RATE HIGH PRESSURE FUEL PUMP

TECHNICAL FIELD

The present invention relates to fuel pumps for internal combustion engines, particularly those used for diesel engine fuel injection. Still more particularly, the present invention relates to a high pressure fuel pump having a variable piston area which provides variable fuel injection rates.

BACKGROUND OF THE INVENTION

Fuel injectors for internal combustion engines require precisely timed delivery of pressurized fuel in order for the engine to have maximized performance and minimized harmful emissions. With respect to diesel engines, it is known that the rate at which fuel is injected affects the amount of $NO_x$ and soot emissions. Specifically, a lower rate of fuel injection during ignition delay provides a lower premixed burnt fraction, which can lower the initial formation of $NO_x$ and soot, and further lower the rate of pressure rise which translates to less combustion noise. Subsequent to the start of combustion, a higher rate of injection promotes a higher rate of diffusion combustion at lower flame temperatures. This results in lower $NO_x$ formation and higher soot oxidation. Contemporary high pressure fuel pumps provide a predetermined rate of fuel injection based upon the cam profile. As can be understood by reference to FIGS. 1 through 3, a prior art high pressure fuel pump 10 has a pump body 12 having a pump cylinder 14 formed therein. A pump piston 16 reciprocates within the pump cylinder 14, wherein a spring 18 biases the pump piston away from the head of the piston cylinder, and an external agency, such as a cam, drives reciprocation of the pump piston. At the head 14H of the pump cylinder 14 is a port 20 which communicates with a passage 22 in the pump body 12 which is interfaced with a solenoid valve 24. A fuel supply connection 26 provides fuel (at a typical pressure of 100 psig) to the solenoid valve. A high pressure fuel connection 28 is also connected with the solenoid valve 24 for supplying high pressure fuel (typically between 1,000 and 5,000 psig) to a fuel injector (or rail therefor).

In operation, a fuel pressurization chamber 30, formed in the pump cylinder 14 between the pump piston 16 and the head 14H, is filled selectively via the solenoid valve 24 with fuel from the fuel supply connection 26 when the pump piston is stroked away from the head of the pump cylinder, the fill stroke. When the pump piston is about to begin the pressurization stroke, the solenoid valve closes off the fuel supply connection and opens the high pressure fuel connection into communication with the fuel pressurization chamber. As the pump piston strokes toward the head of the pump cylinder during the pressurization stroke, the requisite fuel injection pressure is provided as high pressure fuel exits the high pressure fuel connection. In that operation of the high pressure fuel pump inevitably involves internal fuel leakage, a return fuel drain 32 is provided (filled with fuel with a typical pressurization of 10 psig), having a return fuel drain connection 34.

What remains needed in the art is a high pressure fuel pump having a variable fuel injection rate.

SUMMARY OF THE INVENTION

The present invention is a high pressure fuel pump having a variable fuel injection rate.

The high pressure fuel pump according to the present invention includes a pump body, a pump cylinder formed in the pump body and a piston reciprocable within the pump cylinder. The pump piston has a reduced diameter portion which provides a primary piston. A piston annulus is slidably and sealingly mounted on the primary piston, wherein the piston annulus provides a secondary piston. The secondary piston travel is limited by a cylinder wall abutment. The secondary piston defines a demarcation between the fuel pressurization chamber and an oppositely disposed annular actuation chamber. An actuation passage is provided between the return fuel drain and the pump cylinder at the actuation chamber (as it is defined when the primary piston is at the start of the pressurization stroke), wherein the actuation chamber passage is selectively open or closed passively by movement of the pump piston and/or dynamically by operation of an actuation solenoid valve.

In operation, if the actuation passage is open, then during the pressurization stroke the secondary piston will remain stationary relative to the pump body, in that fuel therein is able to flow out from the actuation chamber to the fuel return drain as the fuel actuation chamber contracts. On the other hand, if the actuation passage is closed, then the fuel trapped in the actuation chamber constitutes an incompressible fluid such that as the primary piston strokes toward the head of the pump cylinder during the pressurization stroke, then the secondary piston must stroke therewith in unison.

An actuation assembly provides control over movement of the secondary piston. An example of passive actuation assembly is the pump piston having a larger diameter portion than that at the reduced diameter portion of the primary piston, wherein as the pump piston strokes during the pressurization stroke, the larger diameter portion eventually occludes the entry of the actuation passage. An example of a dynamic actuation assembly is by electronic control of an actuation solenoid valve, wherein as the primary piston strokes during the pressurization stroke, the pressurization passage may be closed or open at any time for any duration by the setting of the actuation solenoid valve. The actuation assembly may be only passive, only dynamic or a combination thereof. When the secondary piston is stationary with respect to the primary piston (in other words, when the secondary piston is moving in unison with the primary piston) during the pressurization stroke, a larger amount of fuel is caused to exit the high pressure fuel connection than would be the case when the secondary piston is stationary with respect to the pump body.

Accordingly, it is an object of the present invention to provide a high pressure fuel pump having selective control over the fuel injection rate.

This and additional objects, features and advantages of the present invention will become clearer from the following specification of a preferred embodiment.

DESCRIPTION OF THE PREFERRED EMBODIMENT

Figure 1:
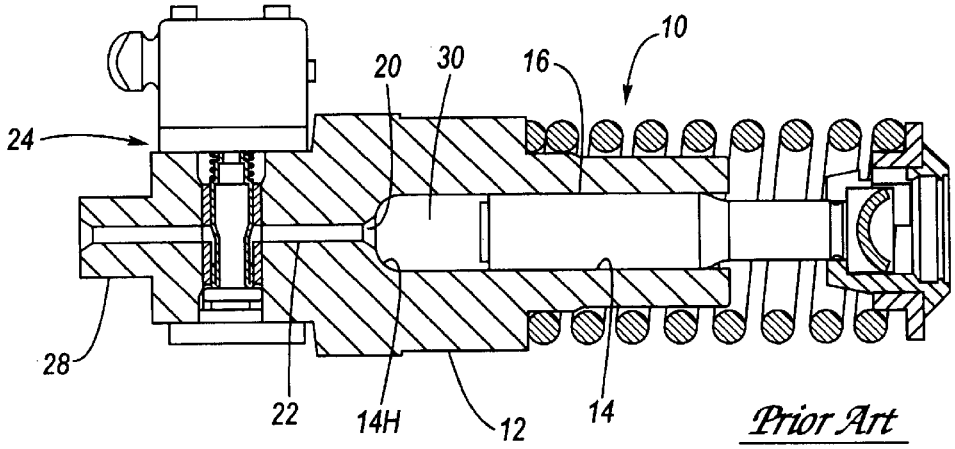
Prior Art Fig. 1
FIG. 1 is a partly sectional side view of a prior art high pressure fuel pump.
Figure 2:
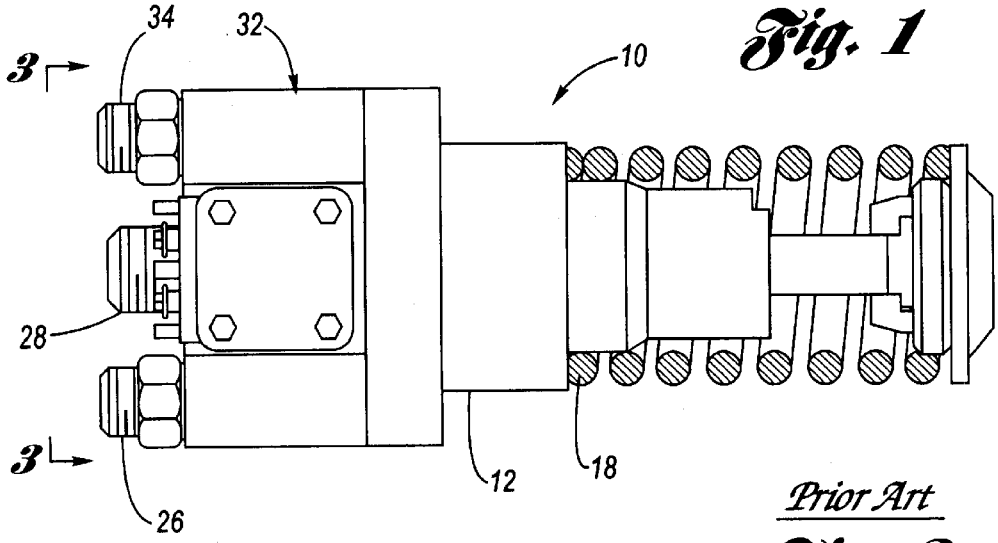
Prior Art Fig. 2
FIG. 2 is a side view of the high pressure fuel pump of FIG. 1.
Figure 3:
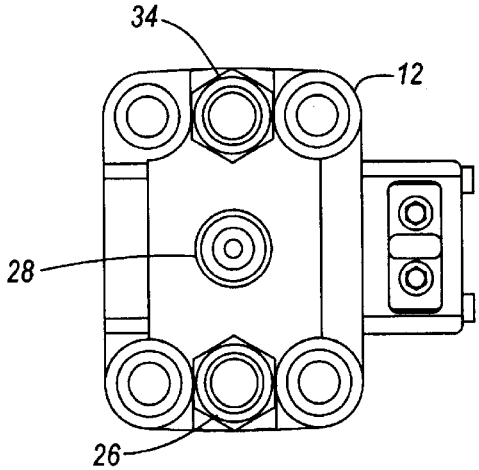
Prior Art Fig. 3
FIG. 3 is a top elevational view of the high pressure fuel pump of FIG. 1, seen along lines 3—3 of FIG. 2.

Referring now to the drawings, FIGS. 4 through 7 depict an example of a high pressure fuel pump 100 according to the present invention, featuring variability of the rate of fuel injection.

A pump body 102 has a pump cylinder 104 formed thereinside, wherein the pump cylinder opens at a lower end portion 102L of the pump body. The pump cylinder 104 has a cylinder wall 104W and a cylinder head 104H formed at an upper end portion 102U of the pump body. A pump piston 106 reciprocates within the pump cylinder 104, wherein a spring 108 biases the pump piston away from the head 104H, and an external agency, such as a cam, drives reciprocation of the pump piston via the opening of the pump cylinder at the lower end of the pump body.

The pump piston 106 has a main diameter portion 110M and a reduced diameter portion 110R, wherein the reduced diameter portion provides a primary piston 112. A piston annulus 114 is slidably mounted on the primary piston 112 in sealing relation therewith, wherein the piston annulus provides a secondary piston 116. The secondary piston 116 travel is limited by a cylinder wall abutment 118. The secondary piston 116 defines a demarcation between the fuel pressurization chamber 120 (formed between the pump piston 106 and the cylinder head 104H) and an oppositely disposed annular actuation chamber 122 (formed between the reduced diameter portion 110R and the cylinder wall 104W and extending axially from the secondary piston 116 to the location whereat the main diameter portion 110M abuts the cylinder wall 104W). By way of example, the cylinder wall abutment 118 is in the form of a reduction in the diameter of the cylinder wall 104W.

An actuation passage 124 for filling the actuation chamber 122 is provided in the pump body 102 between the return fuel drain 126 and the pump cylinder, having an entry 124E at the actuation chamber (as it is defined when the pump piston is commencing the pressurization stroke). An actuation solenoid valve 128 is interfaced with the actuation passage 124 for selectively opening and closing fuel flow between the actuation chamber and the fuel return drain, which is, itself, filled with fuel under relatively low pressure (ie., about 10 psig). The actuation chamber 122 and the actuation passage 124 form a part of an actuation assembly which regulates whether or not the secondary piston 116 moves with the primary piston 112 during the pressurization stroke.

An example of a passive actuation assembly includes the pump piston. In this regard, as the pump piston strokes during the pressurization stroke, the reduced diameter portion 110R is spaced from the entry 124E, such that fuel in the actuation chamber freely flows to the return fuel drain 126 as the main diameter portion 110M approaches and the volume of the actuation chamber gets smaller (contracts). When the main diameter portion 110M reaches the entry 124E, it occludes the entry, effectively closing the actuation passage 124, whereupon the fuel trapped in the actuation chamber 122 is immediately pressurized (because of its incompressibility) and this pressurized fuel in the actuation chamber causes the secondary piston 116 to move in unison with the primary piston 112.

An example of a dynamic actuation assembly includes the actuation solenoid valve 128. Electronic control of operation of the actuation solenoid valve 128 is provided by an electronic circuit. For example, an electronic control module (ECM) 130 has programming which sends a signal to the actuation solenoid valve which regulates its operation responsive to sensed inputs. Sensed inputs may include the status of the combustion stroke of a cylinder subject to fuel injection by the high pressure fuel pump 100. For example, at the sensed beginning of fuel injection, if initial movement of the pump piston 106 involves only the primary piston 112, then a lower rate of fuel injection is provided, resulting in combustion with less noise $NO_x$ and soot generation. At a sensed later stage of the fuel injection, if the pump piston involves both the primary and secondary pistons 112, 116, then a higher rate of fuel injection is provided, resulting in diffusion combustion at lower flame temperatures being promoted.

At the cylinder head 104H of the pump cylinder 104 is a port 132 which communicates with a main passage 134 in the upper end 102U of the pump body 102. The main passage 134 is interfaced with a main solenoid valve 136. A fuel supply connection 138 of the pump body provides fuel (at a typical pressure of 100 psig) to the main solenoid valve 136. A high pressure fuel connection 140 of the pump body is also connected with the main solenoid valve 136 for supplying high pressure fuel (typically between 1,000 and 5,000 psig) to a fuel injector (or rail therefor) from the fuel pressurization chamber 120. The return fuel drain 126 has a return fuel connection 142 of the pump body.

In operation, the fuel pressurization chamber 120 is under a pressure greater than that of the actuation chamber 122 such that the secondary piston retracts to the cylinder wall abutment 118 when the actuation chamber is in open communication with the return fuel drain 126.

As the pump piston 106 (more particularly the primary piston 112) moves away from the head 104H during the fill stroke, the fuel pressurization chamber expands in size. During the fill stroke (executed by, for example, a cam mechanism), the main solenoid valve 136 is set to allow exclusive communication between the fuel supply connection 138 and the main passage 134 such that the fuel pressurization chamber 120 remains fuel filled all during the fill stroke. Upon completion of the fill stroke, the pump piston 106 then moves toward the head 104H of the pump cylinder 104, which movement defines the pressurization stroke.

However, if only the primary piston 112 is to move during a selected portion of the pressurization stroke, then the actuation solenoid valve 128 is set by the ECM 130 to keep the actuation passage 124 in open communication with the fuel return drain 126. Accordingly, as the pump piston 106 moves during the pressurization stroke only the primary piston 112 moves because fuel in the actuation chamber 122 is free to flow into the return fuel drain as the actuation chamber contracts, thereby permitting the secondary piston 116 to remain seated on the cylinder wall abutment 118.

Dynamically, if movement of the pump piston 106 is to include movement of the secondary piston 116 along with the primary piston 112, then the ECM 130 sets the actuation solenoid valve 128 to close 15 communication between the actuation passage 124 and the fuel return drain 126. Accordingly, as the pump piston 106 moves during the pressurization stroke fuel inside the actuation chamber 122 is trapped, and being incompressible, forces the secondary piston 116 to move in unison with the primary piston 112. Because the secondary piston 116 is moving with the primary piston 112, fuel is ejected from the fuel pressurization chamber 120 at a faster rate than would occur if only the primary piston was to move relative to the pump body.

Figure 4:
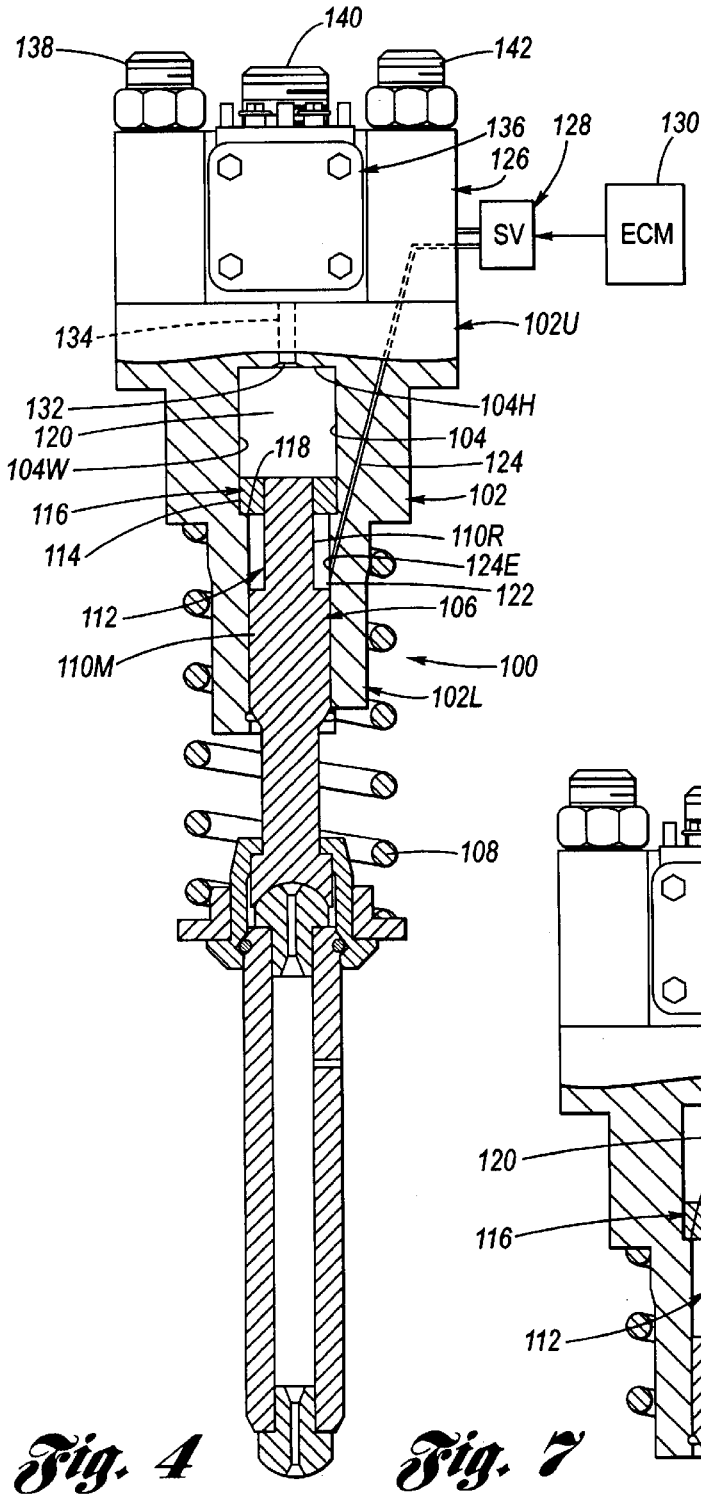
FIG. 4 is a partly sectional top view of a high pressure fuel pump according to the present invention, wherein the primary piston is at the bottom of its stroke.
Figure 5A:
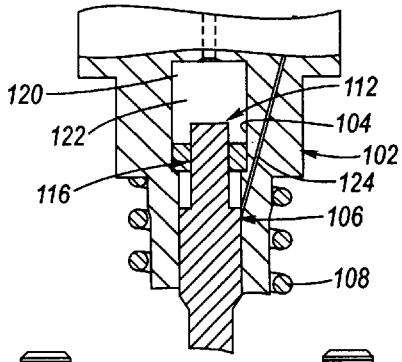
FIG. 5A is a broken-away, partly sectional top view of the high pressure fuel pump of FIG. 4, wherein the primary piston is shown at a mid-point of its stroke and wherein the actuation passage has just become occluded by the pump piston and the actuation solenoid valve is set open.
Figure 5B:
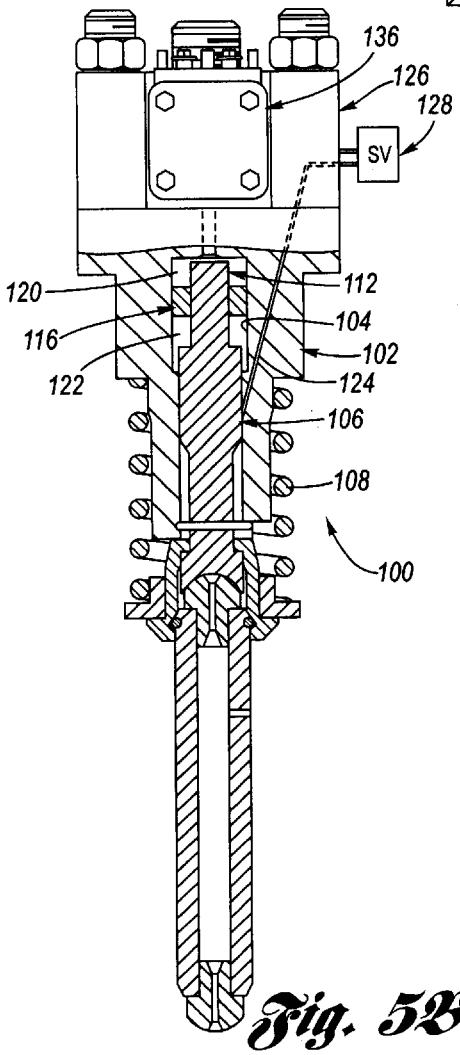
FIG. 5B is a partly sectional top view of the high pressure fuel pump of FIG. 5A, wherein the primary piston is shown at the top of its stroke.

An example of operation is depicted by FIGS. 5A and 5B in combination with FIG. 4. The actuation solenoid valve 128 is either not present or is always set open. As the pump piston 106 strokes during the pressurization stroke (beginning at FIG. 4), fuel flows out of the contracting actuation chamber 122 as the main diameter portion 110M advances. As a result, the secondary piston 116 remains seated at the cylinder wall abutment 118 (see FIG. 5A). However, once the main diameter portion 110M occludes the entry 124E, thereby closing the actuation passage 124. Fuel trapped in the actuation camber 122 is immediately pressurized (because of its incompressibility) and this pressurized fuel in the actuation chamber causes the secondary piston 116 to now move in unison with the primary piston 112 (see FIG. 5B).

Figure 7:
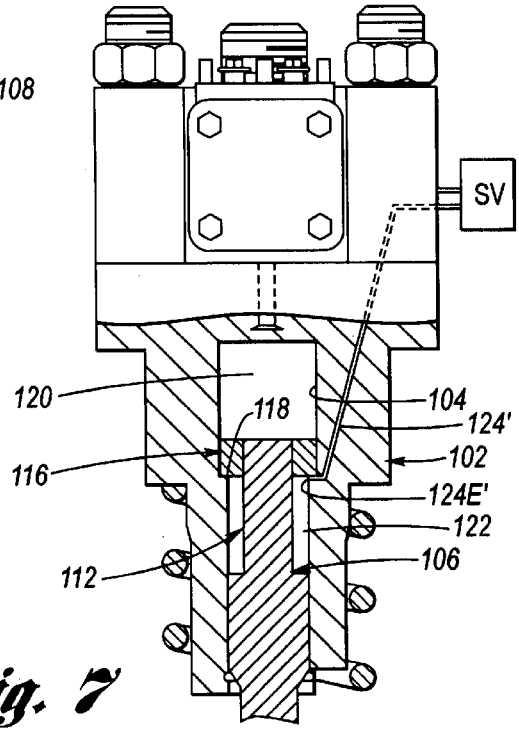
FIG. 7 is a broken away, sectional view of a high pressure fuel pump according to the present invention, showing an alternative actuation passage.

The placement of the entry 124E is operatively selected. If located as shown at FIG. 4, then the main diameter portion 110M can never collide with the secondary piston 116, and the movement of the secondary piston is passively selected. Passive and dynamic actuation assemblies may in this case cooperate. Otherwise, as shown at FIG. 7 the entry 124E' of the actuation passage 124 may be such that the secondary piston 116 will not passively move with the primary piston 112 during the pressurization stroke, in which case only a dynamic actuation assembly is used to control the movement of the secondary piston via the actuation solenoid valve 128.

Figure 6:
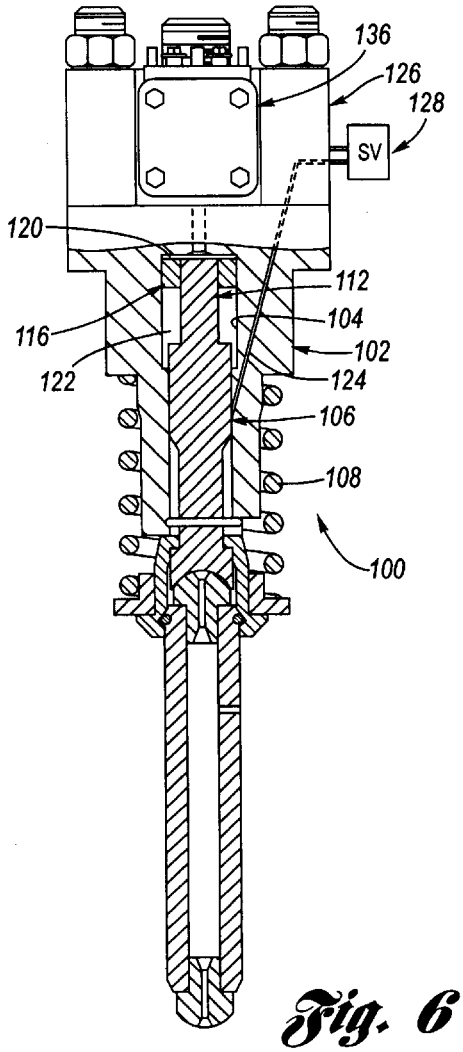
FIG. 6 is a partly sectional top view of the high pressure fuel pump of FIG. 4, wherein the primary piston is shown at the top of its stroke and wherein the actuation passage has been closed during the pressurization stroke.

By way of illustration, FIG. 6 depicts a situation in which the actuation solenoid valve 128 has been set closed all during the pressurization stroke, so that the actuation chamber 122 has not been in communication with the return fuel drain 126 during the entire pressurization stroke. As a result, during the pressurization stroke the secondary piston 116 moved in unison with the primary piston 112.

From the foregoing, it is clear that the movement of the secondary piston with the movement of the primary piston provides an increased rate of fuel injection as compared to that provided by the primary piston alone, and that the movement of the secondary piston with the primary piston may be passively controlled, dynamically controlled or both passively and dynamically controlled. For example, the secondary piston could be caused to move in unison with the primary piston all during the pressurization stroke, or at any time during, for any part of, or for multiple parts of, the pressurization stroke.

To those skilled in the art to which this invention appertains, the above described preferred embodiment may be subject to change or modification. For example, while a fuel pump has been disclosed herein, it is clear that the fuel pump according to the present invention is a pump capable of pumping a liquid other than fuel. Further, the volumes and dimensions shown in the attached drawings are not scalable, the volumes and dimensions shown being meant to be optimized for specific applications. such change or modification can be carried out without departing from the scope of the invention, which is intended to be limited only by the scope of the appended claims.

What is claimed is:

1. A variable output rate pump, comprising:

a pump body having a pump cylinder formed thereinside;

a pump piston reciprocably mounted in said pump cylinder, a pressurization chamber in said pump cylinder being defined by said pump piston, said pump piston comprising:

a primary piston; and a secondary piston slidably mounted to said primary piston; and an actuation assembly for selectively regulating movement of said secondary piston with respect to said primary piston as said primary piston reciprocates.

2. The pump of claim 1, wherein said actuation assembly comprises:

an actuation chamber formed in said pump cylinder adjoining said secondary piston opposite said pressurization chamber;

an actuation passage formed in said pump body extending between an entry at said pump cylinder and a source of liquid; and an actuation solenoid valve interfaced with said actuation passage, said actuation solenoid valve selectively closing and opening communication of said actuation chamber with respect to the source of liquid;

wherein when said actuation solenoid valve is in a closed state liquid in said actuation chamber is trapped, and wherein when said actuation solenoid valve is in an open state and said entry communicates with said actuation chamber then liquid is free to flow from said actuation chamber to the source of liquid.

3. The pump of claim 2, wherein said primary piston comprises a reduced diameter portion of said pump piston, and wherein said secondary piston comprises an annulus sealably mounted on said reduced diameter portion.

4. The pump of claim 3, further comprising an abutment formed in said pump cylinder which defines a limit of movement of said secondary piston.

5. The pump of claim 4, wherein a liquid in said pressurization chamber is at a first pressure, and wherein the source of liquid is at a second pressure, said first pressure being larger than said second pressure.

6. The pump of claim 1, wherein said actuation assembly comprises:

an actuation chamber formed in said pump cylinder adjoining said secondary piston opposite said pressurization chamber;

an actuation passage formed in said pump body extending between an entry at said pump cylinder and a source of liquid; and said primary piston comprising:

a reduced diameter portion of said pump piston, wherein said secondary piston comprises an annulus sealably mounted on said reduced diameter portion; and a main diameter portion having a diameter larger than said reduced diameter portion, said main diameter portion being spaced relative to said entry so as to selectively occlude said entry during reciprocation of said pump piston;

wherein when said main diameter portion occludes said entry then liquid in said actuation chamber is trapped, and wherein when said main diameter portion does not occlude said entry then liquid is free to flow from said actuation chamber to the source of liquid.

7. The pump of claim 6, further comprising an abutment formed in said pump cylinder which defines a limit of movement of said secondary piston; and wherein a liquid in said pressurization chamber is at a first pressure, and wherein the source of liquid is at a second pressure, said first pressure being larger than said second pressure.

8. The pump of claim 6, wherein said actuation assembly further comprises:

an actuation solenoid valve interfaced with said actuation passage, said actuation solenoid valve selectively closing and opening communication of said actuation chamber with respect to the source of liquid;

wherein when said actuation solenoid valve is in a closed state liquid in said actuation chamber is trapped, and wherein when said actuation solenoid valve is in an open state and said entry is not occluded by said main diameter portion then liquid is free to flow from said actuation chamber to the source of liquid.

9. The pump of claim 8, further comprising an abutment formed in said pump cylinder which defines a limit of movement of said secondary piston; and wherein a liquid in said pressurization chamber is at a first pressure, and wherein the source of liquid is at a second pressure, said first pressure being larger than said second pressure.

10. In a high pressure fuel pump comprising a pump body, a fuel input connected to said pump body, a fuel output connected to said pump body, a fuel return drain connected with said pump body, and a main solenoid interfaced with said fuel input and said fuel output an improvement thereto comprising:

said pump body having a pump cylinder formed therein-side;

a pump piston reciprocably mounted in said pump cylinder, a pressurization chamber in said pump cylinder being defined by said pump piston, said pressurization chamber communicating with said main solenoid valve, said pump piston comprising:

a primary piston; and a secondary piston slidably mounted to said primary piston; and an actuation assembly for selectively regulating movement of said secondary piston with respect to said primary piston as said primary piston reciprocates.

11. The pump of claim 10, wherein said actuation assembly comprises:

an actuation chamber formed in said pump cylinder adjoining said secondary piston opposite said pressurization chamber;

an actuation passage formed in said pump body extending between an entry at said pump cylinder and said fuel return drain; and an actuation solenoid valve interfaced with said actuation passage, said actuation solenoid valve selectively closing and opening said actuation chamber with respect to said return fuel drain;

wherein when said actuation solenoid valve is in a closed state then fuel in said actuation chamber is trapped, and wherein when said actuation solenoid valve is in an open state and said entry communicates with said actuation chamber then fuel is free to flow from said actuation chamber to said return fuel drain.

12. The pump of claim 11, wherein said primary piston comprises a reduced diameter portion of said pump piston, and wherein said secondary piston comprises an annulus sealably mounted on said reduced diameter portion; wherein an abutment formed in said pump cylinder defines a limit of movement of said secondary piston; and wherein fuel in said pressurization chamber is at a first pressure, and wherein fuel in said fuel return drain is at a second pressure, said first pressure being larger than said second pressure.

13. The pump of claim 10, wherein said actuation assembly comprises:

an actuation chamber formed in said pump cylinder adjoining said secondary piston opposite said pressurization chamber;

an actuation passage formed in said pump body extending between an entry at said pump cylinder and said fuel return drain; and said primary piston comprising:

a reduced diameter portion of said pump piston, wherein said secondary piston comprises an annulus sealably mounted on said reduced diameter portion; and a main diameter portion having a diameter larger than said reduced diameter portion, said main diameter portion being spaced relative to said entry so as to selectively occlude said entry during reciprocation of said pump piston;

wherein when said main diameter portion occludes said entry then fuel in said actuation chamber is trapped, and wherein when said main diameter portion does not occlude said entry then fuel is free to flow from said actuation chamber to said return fuel drain.

14. The pump of claim 13, further comprising an abutment formed in said pump cylinder which defines a limit of movement of said secondary piston; and wherein fuel in said pressurization chamber is at a first pressure, and wherein fuel in said return fuel drain is at a second pressure, said first pressure being larger than said second pressure.

15. The pump of claim 11, wherein said actuation assembly further comprises:

an actuation solenoid valve interfaced with said actuation passage, said actuation solenoid valve selectively closing and opening communication of said actuation chamber with respect to said return fuel drain;

wherein when said actuation solenoid valve is in a closed state then fuel in said actuation chamber is trapped, and wherein when said actuation solenoid valve is in an open state and said entry is not occluded by said main diameter portion then fuel is free to flow from said actuation chamber to said return fuel drain.

16. The pump of claim 15, further comprising an abutment formed in said pump cylinder which defines a limit of movement of said secondary piston; and wherein fuel in said pressurization chamber is at a first pressure, and wherein fuel in said return fuel drain is at a second pressure, said first pressure being larger than said second pressure.

17. A method for selectively varying the rate of fuel injection of a fuel pump, comprising the steps of:

reciprocating a primary piston in a cylinder, wherein during a fill stroke of the primary piston fuel enters the cylinder and during a pressurization stroke of the primary piston fuel pressurably exits the cylinder; and selectively moving a secondary piston in unison with said primary piston, wherein when said secondary piston moves with said primary piston then the fuel is ejected from the cylinder during said pressurization stroke at a faster rate than when said secondary piston does not move with said primary piston during said pressurization stroke.

18. The method of claim 17, wherein said step selectively moving the secondary piston is carried out by at least one of: passive selection, dynamic selection, and a combination of passive and dynamic selection.

* * * * *